US005316885A

United States Patent [19]

Sasaki et al.

[11] Patent Number: 5,316,885

[45] Date of Patent: May 31, 1994

[54] PULVERULENT INK AND PRINTING METHODS

[75] Inventors: Mitsuhiro Sasaki; Kuniyasu Kawabe, both of Wakayama, Japan

[73] Assignee: Kao Corporation, Tokyo, Japan

[21] Appl. No.: 743,790

[22] Filed: Aug. 12, 1991

[30] Foreign Application Priority Data

Aug. 14, 1990 [JP] Japan ..... 2-214746
Aug. 14, 1990 [JP] Japan ..... 2-214747

[51] Int. Cl.[5] ..... G03C 8/00; G03C 1/72; G03G 13/20; G03G 9/00

[52] U.S. Cl. ..... 430/200; 428/407; 430/126; 430/99; 430/111; 430/138; 430/350; 523/201; 523/205; 523/206; 525/902

[58] Field of Search ..... 523/201, 205, 206; 525/902; 428/407; 430/99, 111, 138, 350, 200, 126

[56] References Cited

U.S. PATENT DOCUMENTS 4,465,755 8/1984 Kiritani et al. ..... 428/407
5,023,159 6/1991 Ong et al. ..... 430/138

FOREIGN PATENT DOCUMENTS 194074 7/1990 Japan .

OTHER PUBLICATIONS

Progress in Organic Coatings, 3 (1975) 73-99 Wicks, Jr. pp. 73, 99.

The Thermal Dissociation of Blocked Toluene Diisocyanates Griffin and Willwerth, vol. 1, No. 4, Dec. 1962, pp. 265-268.

*Primary Examiner*—Paul R. Michl
*Assistant Examiner*—P. Niland
*Attorney, Agent, or Firm*—Birch, Stewart, Kolasch & Birch

[57] ABSTRACT

A powder ink having in the structure a heat-fusible core comprising a thermo-melting substance and a coloring matter and a shell covering the core surface and comprising a resin product obtained by reacting:

(1) 0 to 30 mole % of a monovalent isocyanate compound and/or a monovalent isothiocyanate compound and (2) 100 to 70 mole % of at least divalent isocyanate and/or at least divalent isothiocyanate compound with (3) 0 to 30 mole % of a compound having an active hydrogen atom to react with the isocyanate and isothiocyanate groups of (1) ana (2) and (4) 100 to 70 mole % of a compound having at least two active hydrogen atoms to react with the isocyanate and isothiocyanate groups of (1) and (2); at a molar ratio of (1) and (2) to (3) and (4) in the range between 1:1 and 1:2. At least 30 percent of all the linkages involved in the isocyanates and the isothiocyanates in the resin product are thermally linkages. The powder ink is advantageously used in a method for printing an image on a substrate, which comprises forming an image by a thermally transferring printing method involving an ink sheet and representing the ink sheet with electrostatic energy.

8 Claims, 1 Drawing Sheet

PULVERULENT INK AND PRINTING METHODS

1. Field of the Invention

This invention concerns a pulverulent ink used for image formation. Images are formed through a thermal transfer printing method, and the ink sheets used are represented with electrostatic energy. Ink is used for printing.

Conventional thermal transfer printing methods, apply heating and fusion of image parts. Melted ink is transferred to a recording media by pressing a thermal head against an ink sheet—thereby forming an image on the recording media. The main component of the ink are wax and coloring material.

Printing equipment, which utilizes processes where images are formed through thermal transfer printing and the ink sheets are regenerated with electrostatic energy, has been proposed in Japanese patent Laid-Open No. 209178/1989. An ink sheet regeneration method has been disclosed in Japanese patent Laid-Open No. 209179/1989.

Pulverulent ink, which is used in conventional methods where ink sheets are regenerated with electrostatic energy, has a core primarily consisting of wax, and a shell that largely consists of resin.

However, printing quality cannot be stabilized through the process of forming ink sheets by fusing pulverulent ink. Therefore, methods to improve this point, such as by adding dispersion agents to the ink, have been disclosed in Japanese patent Laid-Open Nos. 78593/1990 and 78594/1990. Japanese patent Laid-Open No. 78595/1990 propose adding anti-oxidizing agents to the ink in order to prevent ink layer deterioration.

However, pulverulent ink does not reduce the amount of energy needed for ink sheet regeneration and thermal transfer. This invention intends to solve the above problems, and its target is that, when pulverulent ink is fused, the inner core and shell easily will fuse under low-energy conditions, that the ink layer is made uniform, and that ink sheets can be regenerated without irregularities. In addition, the invention aims to provide pulverulent ink which allows thermal transfer printing with stable printing quality even at low energies, to provide ink sheets, and printing equipment using ink.

SUMMARY OF THE INVENTION

The pulverulent ink concerned in this invention is pulverulent ink used for image formation where images are formed through thermal transfer printing, and where ink sheets are reproduced with electrostatic energy. The ink is composed of a heat-fusible core containing at least a coloring material and a shell formed so as to cover the surface of the core, wherein the main component of the shell is a resin prepared by reacting an iso(thio)cyanate compound comprising (1) 0 to 30 mole % of monovalent isocyanate and/or isothiocyanate compounds and (2) 100 to 70 mole % of at least divalent isocyanate and/or isothiocyanate compounds with an active hydrogen compound comprising (3) 0 to 30 mole % of a compound having one active hydrogen atom reactive with isocyanate and/or isothiocyanate groups and (4) 100 to 70 mole % of a compound having at least two active hydrogen atoms reactive with isocyanate and/or isothiocyanate groups at a molar ratio of the components (1) and (2) to the components (3) and (4) of between 1:1 and 1:20, and wherein at least 30% of the whole linkages in which an isocyanate or isothiocyanate group participates are thermally dissociating linkages. In addition, the printing method of the invention features the reforming or regeneration of ink sheets by using pulverulent ink. A printing method is also provided which comprises a thermal transfer process to produce images and an ink sheet regeneration process with electrostatic energy, characterized by using the pulverulent ink defined above.

The powder ink of the invention, in other words, comprises in the structure a heat-fusible core comprising a thermo-melting substance and a coloring matter and a shell covering the core on the surface and comprising a resin product obtained by reacting:

(1) 0 to 30 mole % of a monovalent isocyanate compound and/or a monovalent isothiocyanate compound and (2) 100 to 70 mole % of a divalent isocyanate and/or a divalent isothiocyanate compound with (3) 0 to 30 mole % of a compound having an active hydrogen atom to react with the isocyanate and isothiocyanate groups of (1) and (2) and (4) 100 to 70 mole % of a compound having two active hydrogen atoms to react with the isocyanate and isothiocyanate groups of (1) and,(2); at a molar ratio of (1) and (2) to (3) and (4) in the range between 1:1 and 1:20, at least 30 percent of all the linkages involved in the isocyanates and the isothiocyanates in the resin product being thermally associating. The powder ink is advantageously used in a method for printing an image on a substrate, which comprises forming an image by a thermally transferring printing method and regenerating an ink sheet with electrostatic energy.

When using this new pulverulent ink, printing is done through thermal transfer, and ink is supplied to the printing part which is peeled off through the printing. In the process of ink layer regeneration, ink is fused with heat from a heat-roller to form ink sheets. The pulverulent ink used here is composed of a heat-fusible core containing at least a coloring material and a shell formed so as to cover the surface of the core, wherein the main component of the shell is a special resin to improve antiblocking.

The core material is filled with coloring agents, such as carbon black, or magnetic powder. Hydrophobic silica, carbon black etc. is adhered to the surface of the shell to increase the flow rate. The main component of the pulverulent ink's shell is a resin prepared by reacting an iso(thio)cyanate compound comprising (1) 0 to 30 mole % of monovalent isocyanate and/or isothiocyanate compounds and (2) 100 to 70 mole % of at least divalent isocyanate and/or isothiocyanate compounds with an active hydrogen compound comprising (3) 0 to 30 mole % of a compound having one active A chemical compound which has 1 active hydrogen reacting with hydrogen atom reactive with isocyanate and/or isothiocyanate groups and (4) 100 to 70 mole % of a compound having at least two active hydrogen atoms reactive with isocyanate and/or isothiocyanate groups at a molar ratio of the components (1) and (2) to the components (3) and (4) of between 1:1 and 1:20, and wherein at least 30% of the whole linkages in which an isocyanate or isothiocyanate group participates are thermally dissociating linkages (hereinafter called "thermally dissociating polyurethane" or "resin for shell"). According to the present invention, it is preferable that the thermally dissociating linkage be one formed by the reaction between a phenolic hydroxyl or thiol group and an isocyanate or isothiocyanate group, for example a thermally dissociating urethane linkage which dissociates into an isocyanate group and a hydroxyl group at a certain temperature and well known in the field of coating materials as "blocked isocyanate".

The blocking of polyisocyanate is well known as a means for temporarily inhibiting the reaction between an isocyanate group and an active hydrogen compound and various blocking agents such as tertiary alcohols, phenols, acetoacetates and ethyl malonate are described in, for example, Z. W. Wicks Jr., *Prog. in Org. Coatings*, 3, 73 (1975).

It is preferable and essential that the thermally dissociating polyurethane to be used in the present invention have a low thermal dissociation temperature. As understood from the results described in, e.g., G.R. Grittin and L.J. Willwerth, *Ind. Eng. Chem. Prod. Res. Develop.*, 1, 265 (1962), among various urethane linkages, a resin having a urethane linkage formed by the reaction between an isocyanate compound and a phenolic hydroxyl group exhibits a low thermal dissociation temperature and therefore is used favorably.

Thermal dissociation is an equilibrium reaction and, for example, the reaction represented by the following formula is known to proceed from the right to the left with an increasing temperature:

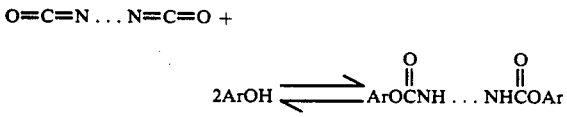

(Wherein Ar represents an aromatic group)

Examples of the monovalent isocianate compound to be used as the component (1) in the present invention include ethyl isocyanate, octyl isocyanate, 2-chloroethyl isocyanate, chlorosulfonyl isocyanate, cyclohexyl isocyanate, n-dodecyl isocyanate, butyl isocyanate, n-hexyl isocyanate, lauryl isocyanate, phenyl isocyanate, m-chlorophenyi isocyanate, 4-chlorophenyl isocyanate, p-cyanophenyl isocyanate, 3,4-dichlorophenyl isocyanate, o-tolyl isocyanate, m-tolyl isocyanate, p-toyl isocyanate, p-toluenesulfonyl isocyanate, 1-napthyl isocyanate, o-nitrophenyl isocyanate, m-nitrophenyl isocyanate, p-nitrophenyl isocyanate, phenyl isocyanate, p-bromophenyl isocyanate, o-methoxypheny, isocyanate, m-methoxyphenyl isocyanate, p-methoxyphenyl isocyanate, ethyl isocyanatoacetate, butyl isocyanatoacetate, and trichloroacetyl isocyanate.

Examples of the divalent or higher isocyanate compound to be used as the component (2) in the present invention include aromatic isocyanate compounds such as 2,4-tolylene diisocyanate, dimer of 2,4-tolylene diisocyanate, 2,6-tolylene diisocyanate, p-xylylene diisocyanate, m-xylylene diisocyanate, 4,4'-diphenylmethane diisocyanate, 1,5-naphtylene diisocyanate, 3,3'-dimethyl-diphenyl-4, 4-diisocyanate, 3,3-dimethyl-diphenylmethane-4,4'-diisocyanate, methaphenylene diisocyanate, triphenylmethane-triisocyanate, and polymethylene-phenyl isocyanate; alipahtic isocyanate compounds such as hexamethylene diisocyanate, trimethyhexamethyl ene diisocyanate, lysine diisocyanate and dimer acid diisocynates; alicyclic isocyanate compounds such as isophrone diisocyanates, 4,4'-methylenebis (cyclohexyl isocyanate), methylcyclohexane-2,4 (or 2,6) diisocyanate and 1,3-(isocyanatomethyl) cyclohexane; and other isocyanate compounds such as an adduct of 1 mol of trimethylolpropane with 3 mol of tolylene diisocyanate.

Examples of the isothiocyanate compound include phenyl isothiocyanate, xylylene-1,4 diisocyanate, and ethylysin diisothiocyanate.

Among these isocyanate and isothiocyanate compounds, a compound having an isocyanate group directly bonded to an aromatic ring is effective in forming a urethane resin having a low thermal dissociation temperature and therefore is preferably used in the present invention.

According to the present invention, the monovalent isocyanate or isothiocyanate compound (1) also serves as a molecular weight modifier for the shell-forming resin an can be used in an amount of at most 30 mole % based on the iso(thio)cyanate component. When the amount exceeds 30 mole %, the storage stability of the obtained pulverulent ink will be poor unfavorably.

Example of the compound having one active hydrogen atom reactive isocyanate and/or isothiocyanate groups to be used as the component (3) in the present invention include aliphatic alcohols such as methyl alcohol, ethyl alcohol, propyl alcohol, isopropyl alcohol, butyl alcohol, isobutyl alcohol, t-butyl alcohol, pentyl alcohol, hexyl alcohol, cyclohexyl alcohol, heptyl alcohol, octyl alcohol, nonyl alcohol, decyl alcohol, lauryl alcohol and stearyl alcohol; aromatic alcohols such as phenol, o-cresol, m-cresol, p-cresol, 4-butylphenol, 2-sec-butylphenol, 2-tert-butylphenol, 3-tert-butylphenol, 4-tert-butylphenol, nonylphenol, isononylphenol, 2-propenylphenol, 3-propenylphenol, 4-propenylphenol, 2-methoxyphenol, 3-methoxy-phenol, 4-methoxy phenol, 3-acetylphenol, 3-carbomethoxyphenol, 2-chlorophenol, 3-chlorophenol, 4-chlorophenol, 2-bromophenol, 3-bromophenol, 4-bromophenol, benzyl alcohol, 1-naphthol, 2-naphthol and 2-acetyl-1-naphthol; and amides such as E-caprolactam.

Particularly, it is preferable to use a phenol derivative represented by the formula (I):

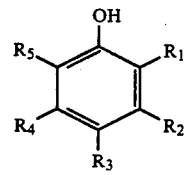

(I)

(Wherein, $R_1$, $R_2$, $R_3$, $R_4$, and $R_5$ each independently represent a hydrogen atom, an alkyl group having 1 to 4 carbon atoms, an alkenyl, alkoxy, alkanoyl, carboalkoxy or aryl group or a halogen atom.

Examples of the dihydric or higher alcohol among the compounds having at least two active hydrogen atoms reactive with isocyanate and/or isothiocyanate groups to be used as the component (4) in the present invention include, catechol, resorcinol, hydroquinone, 4-methylcatechol, 4-t-butylcatechol, 4-acetylcatechol, 3-methoxycatechol, 4-phenyl-catechol, 4-methylresorcinol, 4-ethylresorcinol, 4-t-butylresorcinol, 4-hexylresorcinol, 4-chlororesorcinol, 4-benzylresorcinol, 4-acetyl-resorcinol, 4-carbomethoxyresorcinol, 2-methyl-resorcinol, 5-methyl-resorcinol, t-butylhydroquinone, 2,5-di-t-butylhydroquinone, 2,5-di-t-amylhydrodroquinone, quinone, tetramethylhydroquinone, tetrachlorohydroquinone, methyl carboaminohydroquinone, methylureidohydroquinone, benzonorbornone-3,6-diol, bisphenol A, bisphenol S, 3,3'-dichlorobisphenol S, 2,2'-dihydroxybenzophenone, 2,4-dihydroxybenzophenone, 4,4'-dihydroxybenzophenone, 2,2'-dihydroxydiphenyl, 4,4'-dihydroxydiphenyl, 2,2-dihydroxydiphenylmethane, 3,4-bis (p-hydroxyphenyl) hexane, 1,4-bis (2-(p-hydroxyphenyl) propyl) benzene, bis (4-hydroxyphenyl) mtehylamine, 1,3-dihydrocxy-naphthalene, 1,5-dihydroxynaphthalene, 2,6-dihydroxynaphthalene, 1,5-dihydroxyanthraquinone, 2-hydroxybenzyl alcohol, 4-hydroxybenzyl alcohol, 2-hydroxy-3,5-di-t-butylbenzyl alcohol, 4-hydroxy-3,5-di-tbutylbenzyl alcohol, 4-hydroxyphenethyl alcohol, 2-hydroxyethyl-4-hydroxybenzoate, 2-hydroxyethyl-4-hydroxyphenylacetate, resorcinol-mono-2-hydroxyethyl ether, hydroxyhydroquinone, gallic acid and 3,4,5-trihydroxyethylbenzoate. Particularly catechol derivatives represented by the following formula (II) and resorcinol derivatives represented by the following formula (III) are preferably used:

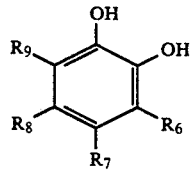

(II)

Wherein $R_6$, $R_7$, $R_8$, and $R_9$ each independently represent a hydrogen atom an alkyl group having 1 to 6 carbon atoms an alkenyl, alkoxy, alkanoyl, carboalkoxy or aryl group or a halogen atom.

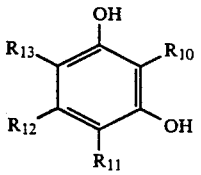

(III)

Wherein $R_{10}$, $R_{11}$, $R_{12}$, and $R_{13}$ each independently represent a hydrogen atom, an alkyl group having 1 to 6 carbon atoms, an alkenyl, alkoxy, alkanoyl, carboalkoxy or aryl group, or a halogen atom.

Further, examples of the compound having at least one isocyanate-or isothiocyanate-reactive functional group other than the hydroxy group and at least one phenolic hydroxyl group include o-hydroxybensoic acid, m-hydroxybenzoic acid, p-hydroxy-benzoic acid, 5-bromo-2-hydroxybenzoic acid, 3-chloro-4-hydroxybenzoic acid, 4-chloro-2-hydroxybenzoic acid, 5-chloro-2-hydroxy-benzoic acid, 3,5-dichloro-4-hydroxybenzoic acid, 3-methyl-2-hydroxybenzoic acid, 5-methoxy-2-hydroxybenzoic acid, 3,5-di-t-butyl-4-hydroxybenzoic acid, 4-amino-2-hydroxybenzoic acid, 5-amino-2-hydroxybenzoic acid, 2,5-dinitrosalicylic acid, sulfosalicylic acid, 4-hydroxy-3-methoxyphenylacetic acid, catechol-4-carboxylic acid, 2,4-dihydroxybenzoic acid, 2,5-dihydroxybenzoic acid, 2,6-dihydroxybenzoic acid, 3,4-dihydroxy-benzoic acid, 3,5-dihydroxybenzoic acid, 3,4-dihydroxyphenylacetic acid, m-hydroxycinnamic acid, phydroxycinnamic acid, 2-amino-4-methylphenol, 2-amino-5-methylphenol, 5-amino-2-methylphenol, 3-amino-2-naphthol, 8-amino-2-naphthol, 1-amino-2-naphthol-4-sulfonic acid, 2-amino -5-naphthol-4-sulfonic acid, 2-amino-4-nitrophenol, 4-amino -2-nitrophenol, 4-amino-2,6-dichlorophenol, o-aminophenol, m-aminophenol, p-aminophenol, 4-chloro-2-aminophenol, 1-amino-4-hydroxyanthraquinone, 5-chloro-2-hydroxyaniline, α-cyano-3-hydroxycinnamic acid, α-cyano-4-hydroxycinnamic acid, 1-hydroxynaphthoic acid, 2-hydroxynaphthoic acid, 3-hydroxynaphthoic acid, and 4-hydroxyphthalic acid.

Further, examples of the Polythiol compound having at least one thiol group in its molecule include ethanethiol, 1-propanethiol, 2-propanthiol, thiophenol, bis (2-mercaptoethyl)ether, 1,2-ethanedithiol, 1,4-butanedithiol, bis (2-inercaptoethyl) sulfide, ethyleneglycol bis (2-mercaptoacetate), ethyleneglycol bis (3-mercaptopropionate), 2,2'-dimethylpropane-diol bis (2-mercaptoacetate), dimethyl propanediol bis (3-mercaptopropionate), trimethyrolpropane tris (2-mercaptoacetate), trimethyrolpropane tris (3-mercapto-propionate), trimethyrolethane tris (3-mercaptopropionate), trimethyrolethane tris (3-mercaptopropionate), pentaerythritol tetrakis (2-mercaptoacetate), pentaerythritol-tetrakis (3-mercapto-propionate), dipentaerythritolhexakis (2-mercapto-acetate), dipentaerythritolhexakis (3-mercaptopropionate), 1,2-dimercapto-benzene, 4-methyl-1,2-dimercaptobenzene, 3,6-dichloro-1,2-dimercaptobenzene, 2,4,5,6-tetrachloro-1,2-dimercaptobenzene, xylylenedithiol, and 1,3,5-tris (3-mercaptopropyl) isocyanulate.

In the thermally dissociating shell-forming resin according to the present invention, at least 30%, preferably at least of the whole linkages in which an isocyanate or isothiocyanate group participates are thermally dissociating linkages. When the content of the thermally dissociating linkages is less than 30%, the strength of the capsule shell will not be sufficiently lowered in the reproduction by heat roll, so that the core cannot be fully reproduced through low energy transfer.

According to the present invention, other compounds having an isocyanate-reactive functional group other than phenolic hydroxyl and thiol groups, for example, the following active methylene compounds such as malonate or acetoacetate, oxime such as methyl ethyl ketone oxime, carboxylic acid, polyol, polyaminel aminocarboxylic acid or aminoalcohol may be used as a shell forming material in such an amount as not to lower the ratio of the linkages formed by the reaction of isocyanate and/or isothiocyanate groups with phenolic hydroxyl and/or thiol groups to the whole linkages in which an isocyanate or isothiocyanate group participates to less than 30%.

The active methylene compound includes malonic acid, monomethyl malonate, monoethyl malonate, isopropyl malonate, dimethyl malonate, diethyl malonate, diisopropyl malonate, t-butyl ethyl malonate, diamide malonate, acetylacetone, methyl acetoacetate, ethyl acetoacetate, tert-butyl acetoacetate, and allyl acetoacetate.

The carboxylic acids includes monocarboxylic acid such as acetic acid, propionic acid, butyric acid, isobutyric acid, pentanoic acid, hexanoic acid, and benzoic acid; dicarboxylic acids such as maleic acid, fumaric acid, citraconic acid, itaconic acid, glutaconic acid, phthalic acid, isopthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid and n-octylsuccinic acid; and tribasic and higher carboxylic acids such as 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene-carboxypropane, 1,2,4-cyclohexanetricarboxylic acid, tetra (metylenecarboxyl) methane, 1,2,7,8-octanetetracarboxylic acid pyromellitic acid, and Empol trimer acid.

Examples of polyol include, diols such as ethylene glycol, propylene glycol, butylene glycol, neopentyl glycol, hexamethyleneglycol, diethylene glycol, and dipropylen glycol; triols such as glycerol, trimethylolprone glycol, and dipropylene glycol; triols such as glycerol, trimethyrolpropane, trimethylolethane, and 1,2,6-hexanetriol; pentaerythritol and water, while those of the polyamine include ethylenediamine, hexamtehylenediamine, diethylenetriamine, iminobispropylamine, phenylenediamine, xylylenediamine, and triethylenetetramine.

According to the present invention, the compound having one active hydrogen atom reactive with isocyanate and/or isothiocyanate groups as the component (3) may be used in an amount of at most 30 mole % based on the active hydrogen component.

When the amount exceeds 30 mole %, the storage stability of the pulverulent ink will be poor unfavorably.

Further, it is preferable in order to obtain a resin free from unreacted isocyanate groups that the molar ratio of the iso(thio)cyanate compound comprising the component (1) and (2) to the active hydrogen compounds comprising the component (3) and (4) lie between 1:1 and 1:20.

In the preparation of the pulverulent ink, according to the present invention, the shell is preferably formed by interfacial polymerization or in situ polymerization. Alternatively, it may be formed by a dry process comprising stirring a matrix particle as a core together with a particle of a shell forming material, having a number-average particle diameter of one-eighth or below of that of the matrix particle in a stream of air at a high rate.

Although the shell-forming resin can be prepared in the absence of any catalyst, it may be prepared in the presence of a catalyst. The catalyst may be any conventional one used for the preparation of urethanes and includes tin catalysts such as dibutyltin dilaurate and amine catalysts such as 1,4-diazabicyclo [2,2,2] octane and N,N,N-tris (dimethylaminopropyl)-hexahydro-S-triazine.

The resin to be used as core material of the pulverulent ink according to the present invention is a thermoplastic resin having a glass transition temperature (Tg) of 10° to 50° C. and examples thereof include polyester, polyesterpolyamide,, polyamide and vinyl resins, among which vinyl resins are particularly preferable.

Examples of the monomer constituting the vinyl resin include styrene and its derivatives such as styrene, o-methylstyrene, m-methylstyrene, p-methylstyrene, a-methylstyrene, p-ethylstryrene, 2,4-dimethylstyrene, p-chlorostyrene and vinylnaphthalene; ethylenically unsaturated monoolefins such as ethylene, propylene, butylene and isobutylene; vinylesters such as vinylchloride, vinyl bromide, vinyl fluoride, vinyl acetate, vinyl propionate, vinyl formate and vinyl caproate; ethylenic monocarboxylic acids and esters thereof such as acrylic acid, methyl acrylate, ethyl acrylate, n-propyl acrylate,, isopropyl acrylate, n-butyl acrylate,, isobutyl acrylate, t-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl cx-chloroacrylate, methacrylic acid, methyl methacrylate, ethyl methacrylate, n-propyl methacrylate, isopropyl methacrylate, n-butyl methacrylate, isobutyl methacrylate, t-butyl methacrylate, amyl methacrylate/ cyclohexyl methacrylate,, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate and diethylaminoehyl methacrylate; ethylenic monocarboxylic acid derivatives such as acrylonitrile, methacrylonitrile and acrylamide; ethylenic dicarboxylic acids and derivatives thereof such as dimethyl maleate; vinyl ketones such as vinyl methylketone; vinyl ethers such as vinyl methyl ether; vinylidene halides such as vinylidene chloride; and N-vinyl compounds such as N-vinylpyrrole and N-vinyl Pyrrolidone.

Among the above core resin-constituting monomers it is preferable that the core-forming resin contain styrene or its derivatives still preferable in an amount 50 to 90 parts by weight for forming the main skeleton of the resin and an ethylenic monocarboxylic acid or an ester thereof still preferably in an amount of 10 to 50 parts by weight for controlling the thermal characteristics of the resin such as a softening point.

When the monomer composition constituting the core-forming resin according to the present invention contains a crosslinking agent may be suitably selected from among divinylbenzene, divinylnaphthalene, polyethylene glycol dimethacrylate, diethylene glycol diacrylate., triethylene glycol diacrylate, 1,3-butylene glycol dimethacrylate, 1,6-hexyleneglycol dimethacrylate, neopentylglycol dimethacrylate, dipropyleneglycol dimethacrylate, polypropyleneglycol dimethacrylate, 2,2-bis (4-methacryloxy-diethoxyphenyl) propane, 2,2-bis (4-acryloxy-diethoxyphenyl) propane, trimethyrolpropane trimethacrylate, trimethyrolpropane triacrylate, tetramethyrolmethane tetracrylate, dibromoneopentyl glycol dimethacrylate, and diallyl phthalate, which may be also used as a mixture of two or more of them.

If the amount of the crosslinking agent added is too large, the pulverulent ink will be difficultly heat-fusible and ink sheet reproductivity and thermal transfer capability will fall.

The amount of the crosslinking agent to be added is-preferably 0.001 to 15% by weight (still preferably 0.1 to 10% by weight) based on the monomers used.

A graft or crosslinked polymer prepared by polymerizing the above monomers in the presence of an unsaturated polyester may be also used as the resin for the core.

Examples of the polymerization initiator to be used in the preparation of the vinyl resin include azo and diazo polmernation initiators such as 2,2- azobis (2,4-dimethylvaleronitrile), 2,2-azobis-isobutyronitrile, 1,1-azobis (cyclohexane-1-carbonitrile), 2,2-azobisisobutyronitrile, 1,1-azobis(cyclohexane-1-carbonitrile), 2,2-azobis-4-methoxy-2,4-dimethylvaleronitrile; and peroxide, polymerization initiators such as benzoyl peroxide, methyl ethyl ketone peroxide, isopropyl peroxycarbonate, cumen hydroperoxide, 2,4-dichlorobenzoyl peroxide, lauroyl peroxide and dicumyl peroxide.

Two or more polymerization initiators may be used mixedly for the purpose of controlling the molecular weight or molecular weight distribution of the polymer or the reaction time.

The amount of the polymerization initiator to be used is 0.1 to 20 parts by weight, preferably 1 to 10 parts by weight per 100 parts by weight of the monomers to be polymerized.

The core may contain one or more off-set inhibitors for the purpose of improving mold releasing capability during ink sheet reproduction and examples of the off-set inhibitor include polyolefins metal salts of, fatty acid, fatty acid esters, partially saponified fatty acid esters, higher fatty acids, higher alcohols, paraffin waxes, amide waxes, polyhydric alcohol esters, silicone varnish, aliphatic fluorocarbon and silicone oils.

The above polyolefin is a resin selected from among polypropylene, polyethylene and polybutene and their softening point is 80°–160°. The above metal salt of fatty acid includes salts of maleic acid with zinc, magnesium or calcium; those of stearic acid with zinc, cadmium, barium, lead, iron, nickel, cobalt, copper, aluminum or magnesium; dibasic lead stearate; salts of oleic acid with zinc, magnesium, iron, cobalt, copper, lead or calcium; those of palmitic acid with aluminum or calcium; caprylate; lead caproate salts of linoleic acid with zinc or cobalt; calcium ricinoleate; salts of recinoleic acid with zinc or cadmium; and mixtures thereof. The above fatty acid ester includes ethyl maleate, butyl maleate, methyl stearate, butyl stearate, cetyl palmitate and etylene glycol montanate. The above partially saponified fatty acid seter includes calcium partially saponified montanate. The above higher fatty acid includes dodecanoic, lauric, myristic, palmitic, stearic, oleic, linoleic, ricinoleic, arachic, behenic, lignoceric, and selacholeic acids and mextures of them. The above higher alcohol includes dodecyl, lauryl myristyl, palmityl, stearyl arachyl, and behenyl alcohol. The above paraffin wax includes natural parafins, microwax, synthetic parafin and chlorinated hydrocarbons.

The amiae wax preferably includes stearamide, oleamide, palmitamide, lauramide, behenamide, methylene-bis-stearamide, ethylene-bis-stearamide, N,N'-m-xylylene-bis-stearamide, N,N'-m-xylylene-bis-12-hydroxystearamide, N,N'-isophthalic-bis-stearamide and N,N'-isophthalic-bis-12-hydroxystearamide.

Examples of the polyhydric alcohol ester include glycerin stearate, glycerin ricinoleate, glycerin monobehenate, sorbitan monostearate, propylene glycol monostearate and sorbitan trioleate. Examples of the silicone varnish include methylsilicone varnish and phenylsilicone varnish. Examples of the aliphatic fluorocarbon include low polymers of tetrafluoroethylene and hexafluoropropylene or fluorinated surfactants described in Japanese Patent Laid-Open No. 124428/1978.

In the production of an encapsulated powdered ink, when the outer shell is formed by the interfacial polymerization or in-situ polymerization, the use of an excessive amount of the above-described compound having a functional group reactive with an isocyanate group, such as a higher fatty acid or higher alcohol, is unfavorable because of the inhibition of the formation of the outer shell.

The proportion of the offset preventive is preferably 1 to 20% by weight based on the resin in the core material.

In the present invention, a colorant is incorporated in the core material of the encapsulated powdered ink, and any of dyes, pigments and other colorants used as a colorant in the conventional powdered ink may be used as the colorant.

Examples of the colorant used in the present invention include various carbon blacks produced by thermal black process, acetylene black process, channel black process, lamp black process or other processes, a grafted carbon black comprising a carbon black having a surface coated with a resin, nigrosine dyes, Phthalocyanine Blue, Permanent Brown FG, Brillant Fast Scarlet, Pigment Green B, Rhodamine B Base, Solvent Red 49, Solvent Red 146 and Solvent Blue 35 and mixtures thereof. The colorant is usually used in an amount of about 1 to 15 parts by weight based on 100 parts by weight of the resin in the core material.

A magnetic particle may be added to the core material to produce a magnetic powdered ink. Examples of the magnetic particle include ferromagnetic metals, alloys, such as iron, cobalt and nickel, including ferrite and magnetite, compounds containing the above-described elements, or alloys not containing a ferromagnetic element but exhibiting ferromagnetism upon being subjected to a suitable heat treatment, for example, alloys called "Heusler alloys" containing manganese and copper, such as manganese-copper-aluminum and manganese-copper-tin, and chromium dioxide. The magnetic material is homogeneously dispersed in the core material in the form of a fine powder having a mean particle diameter of 0.1 to 1 μm. The content of the magnetic material is 5 to 70 parts by weight, preferably 10 to 60 parts by weight based on 100 parts by weight of the powdered ink.

A fine powder of the magnetic material may be incorporated in the core material to produce a magnetic powdered ink through the same treatment as that used in the case of the colorant. Since the fine powder of the magnetic material, as such, is poor in the affinity for organic substances such as the core material and monomers, however, it is used in combination with the so-called "coupling agent", such as a titanium coupling agent, silane coupling agent or lecithin, or after treatment with the coupling agent. This enables the fine powder of the magnetic-material to be homogeneously dispersed in the core material.

When the encapsulated powdered ink is produced by the interfacial polymerization or in-situ polymerization, it is necessary to incorporate a dispersion stabilizer in the dispersant for the purpose of dispersing an outer shell forming material and a core material forming material in a dispersant and, at the same time, preventing the aggregation and coalescence of a dispersoid.

Examples of the dispersion stabilizers include gelatin, gelatin derivatives, polyvinyl alcohol, polystyrenesulfonic acid, hydroxymethylcellulose, hydroxyethylcellulose, hydroxypropylcellulose, carboxymethylcellulose sodium, polysodium acrylate, sodium dodecylbenzenesulfonate, sodium tetradecyl sulfate, sodium pentadecyl sulfate, sodium octyl sulfate, sodium allyl-alkyl-polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-β-naphthol-disulfonate, colloidal silica, alumina, tricalcium phosphate, ferric hydroxide, titanium hydroxide, aluminum hydroxide and other dispersion stabilizers. These dispersion stabilizers may be used also in the form of a combination of two or more of them.

Examples of the dispersion medium for the dispersion stabilizer include water, methanol, ethanol, propanol, butanol, ethylene glycol, glycerin, acetonitrile, acetone, isopropyl ether, tetrahydrofuran and dioxane. They may be used alone or in the form of a mixture of two or more of them.

In the present invention, it is preferred that the major component of the heat-meltable core material be a thermoplastic resin and the glass transition point attributable to the resin be 10° to 50° C. When the glass transition point is below 10° C., the storage stability of the encapsulated powdered ink deteriorates while when it exceeds 50° C., the capability of ink sheet regeneration and the thermal transfer performance are impaired unfavorably. In the present invention, the "glass transition point" is defined as a temperature of an intersection of the extension of a base line located below the glass transition point and a tangent exhibiting the maximum gradient between the rise portion of the peak and the top of the peak as determined at a temperature rise rate of 10° C./min through the use of a differential scanning calorimeter (manufactured by Seiko Instruments Inc.).

In the present invention, the softening point of the encapsulated powdered ink is preferably 60° to 130° C. When the softening point is below 60° C., the blocking resistance deteriorates, while when it exceeds 130° C., the capability of ink sheet regeneration and the thermal transfer performance are impaired unfavorably. In the present invention, the term "softening point" is defined as follows. A load of 20 kg/ $cm^2$ is applied to a sample having a size of 1 $cm^3$ by means of a plunger of a Koka flow tester (manufactured by Shimadzu Seisakusho Ltd.) while heating the sample at a temperature rise rate of 6° C./min to extrude a nozzle having a diameter of 1 mm and a length of 1 mm. In this case, the degree of drop of the plunger (flow value) of the flow tester is plotted against the temperature to obtain an S-shaped curve. The temperature corresponding to one half of the height (h) of the S-shaped curved is defined as the softening point.

In the present invention, although there is no particular limitation on the particle diameter of the encapsulated powdered ink, the mean particle diameter is usually 3 to 30 μm.

The thickness of the outer shell of the encapsulated powdered ink is preferably 0.01 to 1 μm. When the thickness is less than 0.01 gm, the blocking resistance deteriorates, while when the thickness exceeds 1 μm, the heat-meltability deteriorates unfavorably.

In the present invention, the encapsulated powdered ink may be used in combination with a flow improver. Examples of the flow improver include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, silicon carbide and silicon nitride. An impalpable powder of silica is particularly preferred.

The impalpable powder of silica is one having a Si-O-Si linkage and may be prepared by any of the dry and wet processes. Although any of aluminum silicate, sodium silicate, potassium silicate, magnesium silicate and zinc silicate may be used besides anhydrous silicon dioxide, it is preferred that the impalpable powder have a $SiO_2$ content of not less than 85% by weight. It is also possible to use an impalpable powder of silica subjected to a surface treatment with a silane coupling agent, a titanium coupling agent, a silicone oil, a silicone oil having an amine on its side chain, or other agents.

Further, a minor amount of carbon black or the like may be used for the purpose of regulating the color tone and resistance. Various types of known conventional carbon blacks, such as furnace black, channel black and acetylene black, may be used as the carbon black.

Figure 1:
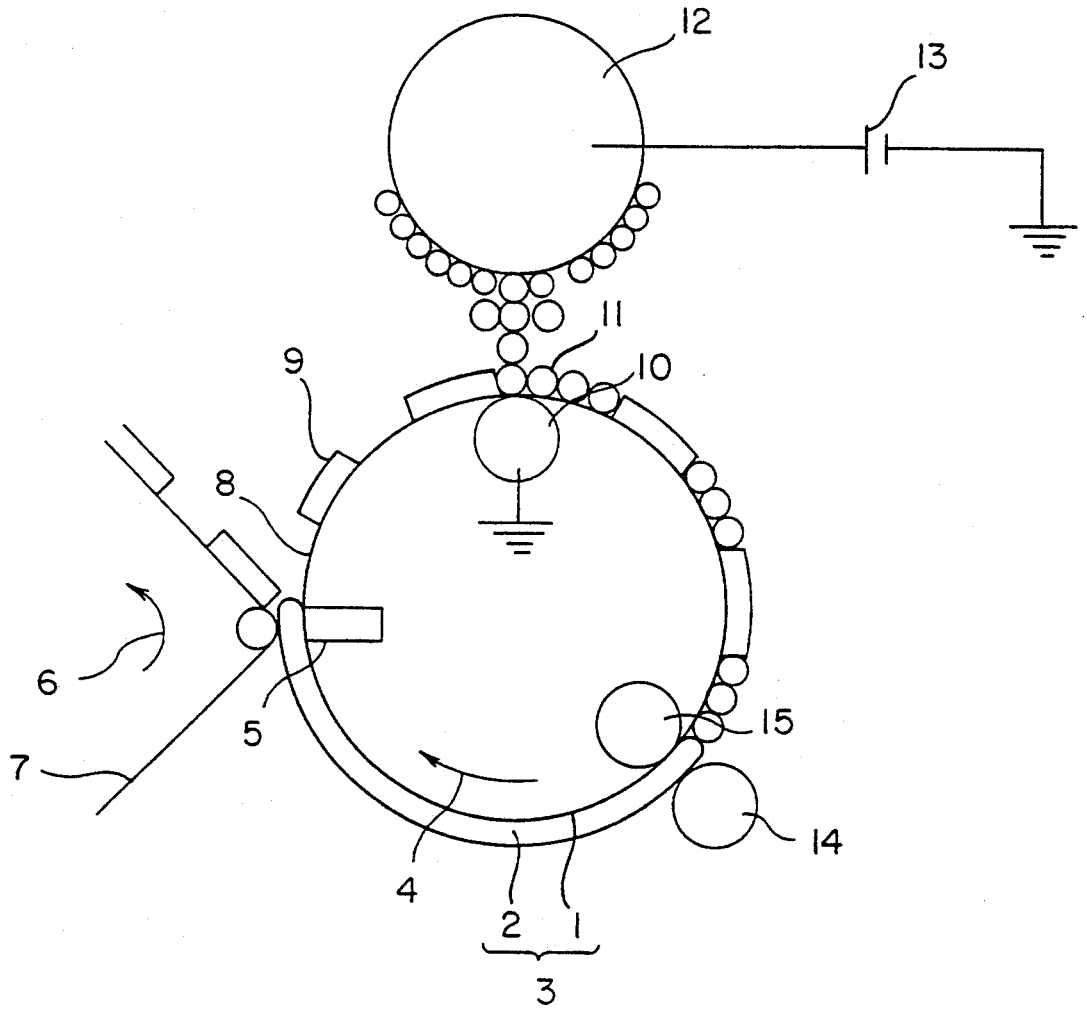
FIG. 1 is a diagram showing a process for forming an image through the use of a printing apparatus comprising the step of forming an image according to a thermal transfer printing process and the step of regenerating an ink sheet through the use of an electrostatic force.

1 insulating support,
2 ink layer,
3 ink sheet,
4 direction of movement,
5 thermal head,
6 direction of movement,
7 recording medium,
8 ink layer peeling portion,
9 ink layer depositing portion,
10 electrode,
11 powdered ink,
12 conductive roller,
13 Power source,
14 heat roller, and
15 support roller.

FIG. 1 shows a process for forming an image with a printing apparatus comprising the step of forming an image according to a thermal transfer printing process using the powdered ink of the present invention and the step of regenerating an ink sheet through the use of an electrostatic force.

The step of forming an image according to a thermal transfer printing process comprises moving an ink sheet 3 comprising an ink layer 2 provided on an insulating support 1 in the direction indicated by an arrow 4 to transfer the ink by means of a thermal head 5 to a recording medium 7 advancing in the direction indicated by an arrow 6, thereby forming an image on the recording medium 7. The formation of an image causes the formation of an ink layer peeling portion 8 and an ink layer depositing portion 9 in the ink sheet 3. In the subsequent step of regeneration of the ink sheet, an electrode 10 is provided so as to come into contact with the insulating support 2 of the ink sheet 3, a conductive roller 12 for successively feeding a powdered ink on the ink sheet 3 is provided opposite to the electrode 10 with the ink sheet 3 sandwiched therebetween, a bias voltage is applied by means of a power source 13 across the electrode 10 and the conductive roller 12 to feed the powdered ink 11 on the ink sheet 3. The powdered ink 11 in contact with the ink layer peeling portion 8 of the ink sheet 3 is loaded with an electric charge in a quantity proportional to a product of the electrostatic capacity of the insulating support 1 and the bias voltage because the ink layer peeling portion 8 is electrically insulating and consequently adheres to the insulating support 1 through an electrostatic force. On the other hand, no adhesive force is generated in a powdered ink 11 in contact with the ink layer depositing portion 9 of the ink sheet 3 and a powdered ink 11 in contact with another powdered ink already deposited on the insulating support 1, since the ink layer 2 and the powdered ink 11 are electrically conductive and therefore serve as a conductive path. Thus, the powdered ink 11 supplied to only the ink layer peeling portion 8 of the ink sheet 3 is fixed on the insulating support 1 by means of a heat roller 14 and a support roller 15 to form an ink layer 2, thus regenerating an ink sheet 3. Resin films such as polyethylene terephthalate, polyaramid or polyimide may be used as the insulating support of the ink sheet. Besides a head used in the melt thermal transfer system, a styrus head used in the electric thermal transfer system can be used as the thermal head 5. Further, in the case of the electric thermal transfer system, the construction of the ink sheet is such that an energized layer or the like is formed opposite to the ink layer with the ink sheet sandwiched therebetween. Plain paper, OHP sheets, etc. may be used as the recording medium 7. The magnetic brush development process, contact development process and other processes known in the electrophotographic system may be applied to the conductive roller 12 for carrying a powdered ink. Similarly, the heat roll fixation, flash fixation and other fixation processes known in the electrophotographic system may be applied to the heat roller 14 and the support roller 15.

As described above, according to the present invention, in a powdered ink used in a process for forming an image comprising the step of forming an image according to a thermal transfer printing process and the step of regenerating an ink sheet through the use of an electrostatic force, since the outer shell of an encapsulated powdered ink comprising a heat-meltable core material having a surface coated with an outer shell is mainly composed of a resin having a thermally dissociative urethane linkage during the melting of the powdered ink by the use of such an outer shell, so that a uniform ink sheet is formed. Further, it became possible to provide a printing apparatus having a stable printing quality with a low printing energy through the use of this ink sheet.

The powdered ink and printing apparatus according to the present invention can be extensively applied to apparatuses wherein an image is formed according to a process comprising the step of forming an image according to a thermal transfer system and the step of regenerating an ink sheet, for example, printers, copying machines, facsimiles and other apparatuses.

The present invention will now be described by referring to the following Examples, though it is not limited to these Examples only.

EXAMPLE 1

65.0 parts by weight of styrene was mixed with 35.0 parts by weight of 2-ethylhexyl acrylate, 10.0 parts by weight of carbon black "#44" (manufactured by Mitsubishi Chemical Industries, Ltd.), 4.0 parts by weight of 2,2'-azobisisobutyronitrile and 9.5 parts by weight of 4,4'-diphenylmethane diisocyanate ("Millionate MT"; a product of Nippon Polyurethane Industry Co., Ltd.), and the mixture was placed in an attritor (manufactured by Mitsui Make Engineering Corp.) where dispersion was conducted at 10° C. for hr, thereby preparing a polymerizable composition. The composition thus prepared was added to 800 g of an aqueous colloid solution of 4% by weight of tricalcium phosphate previously prepared in a 2-l glass separable flask in such an amount that the composition was 40% by weight. The mixture was dispersed by means of a TK homomixer (manufactured by Tokushu Kika Kogyo Co., Ltd.) at a temperature of 5° C. at a number of revolutions of 10000 rpm for 2 min. A four-necked glass lid was put on the flask, and the flask was equipped with a reflux condenser, a thermometer, a dropping funnel with a nitrogen inlet and a stainless steel stirring rod and placed in an electrothermic mantle. A mixed solution comprising 8.1 g of resorcinol, 7.9 g of m-aminophenol, 0.7 g of dibutyltin dilaurate and 40 g of ion-exchanged water was prepared and added in drops through the dropping funnel while stirring over a period of 30 min. Thereafter, the mixture was heated to a temperature of 80° C. while continuing the stirring under nitrogen, and a reaction was allowed to proceed for 10 hr. The reaction mixture was cooled, and a dispersant in the form of a 10% aqueous hydrochloric acid solution was dissolved therein. The dispersion was filtered, and the solid matter was washed with water, dried under a reduced pressure of 20 Mm Hg at 45° C. for 12 hr, and classified by means of a pneumatic classifier, thereby preparing an encapsulated powder having a mean particle diameter of 15.0 μm wherein the outer shell comprised a resin having a thermally dissociative urethane linkage.

2.0 parts by weight of carbon black ("Vulcan XC-72R"; a product of Cabot) and 0.4 part by weight of an impalpable powder of a hydrophobic silica ("Aerosil R-972"; a product of Nippon Aerosil Co., Ltd.) were added and mixed with 100 parts by weight of the capsule thus prepaged, thereby preparing the powdered ink according to the present invention. This powdered ink will be referred to as the powdered ink 1. The glass transition point attributable to the resin in the core material was 30.2° C., and the softening point of the powdered ink 1 was 80.5° C.

EXAMPLE 2

The procedure up to the surface treatment step in Example 1 was repeated, except that 25.0 parts by weight of magnetite ("EPT-1001"; a product of Toda Kogyo Corp.) was used instead of 10.0 parts by weight of the carbon black "#44", thereby preparing a powdered ink. This powdered ink will be referred to as the powdered ink 2. The glass transition point attributable to the resin in the core material was 30.2° C., and the softening point of the powdered ink 2 was 86.0° C.

COMPARATIVE EXAMPLE 1

The procedure up to the surface treatment step in Example 1 was repeated, except that 15.2 g of neopentyl glycol was used instead of 8.1 g of resorcinol and 7.9 g of m-aminophenol, thereby preparing a powdered ink. This powdered ink will be referred to as the comparative powdered ink 1. The glass transition point attributable to the resin in the core material was 30.2° C., and the softening point of the comparative powdered ink 1 was 84.5° C.

COMPARATIVE EXAMPLE 2

In order to prepare a core substance of a powdered ink, 20 parts by weight of a paraffin wax (softening point: 62° C.) was melt-kneaded with 20.0 parts by weight of carnauba wax (having a softening point 82° C. manufactured by Noda Wax Co., Ltd.), 30.0 parts by weight of an ethylene-vinyl acetate copolymer ("ULV" having a molecular weight of 3500 and a vinyl acetate content of 25% by weight, manufactured by Mitsubishi Petrochemical Co., Ltd.) and 10.0 parts by weight of carbon black ("#44" manufactured by Mitsubishi Chemical Industries, Ltd.) by means of a pressure kneader, and the mixture was cooled, pulverized and classified to prepare a particle having a diameter of 15 μm. This core substance was coated with a shell material having a coating thickness of 0.3 μm and comprising a styrene-2-ethylhexyl acrylate copolymer (weight ratio: 90/10), thereby preparing an encapsulated powder.

2.0 parts by weight of carbon black ("Vulcan XC-72R"; a product of Cabot) and 0.4 part by weight of an impalpable powder of a hydrophobic silica ("Aerosil R-972"; a product of Nippon Aerosil Co., Ltd.) were added and mixed with 100 parts by weight of the encapsulated powder thus prepared, thereby preparing a powdered ink. This powdered ink will be referred to as the comparative powdered ink 2.

EXAMPLE 3

65.0 parts by weight of styrene was mixed with 35.0 parts by weight of 2-ethylhexyl acrylate, 10.0 parts by weight of carbon black "#44" (manufactured by Mitsubishi Chemical Industries, Ltd.), 4.0 parts by weight of 2,2'-azobisisobutyronitrile and 9.5 parts by weight of 4,4'-diphenylmethane diisocyanate ("Millionate MT"; a product of Nippon Polyurethane Industry Co., Ltd.), and the mixture was placed in an attritor (manufactured by Mitsui Make Engineering Corp.) where dispersion was conducted at 10° C. for 5 hr, thereby preparing a polymerizable composition. The composition thus prepared was added to 800 g of an aqueous colloid solution of 4% by weight of tricalcium phosphate previously prepared in a 2-l glass separable flask in such an amount that the composition was 40% by weight. The mixture was dispersed by means of a TK homomixer (manufactured by Tokushu Kika Kogyo Co., Ltd.) at a temperature of 5° C. at a number of revolutions of 10000 rpm for 2 min. A four-necked glass lid was put on the flask, and the flask was equipped with a reflux condenser, a thermometer, a dropping funnel with a nitrogen inlet and a stainless steel stirring rod and placed in an electrothermic mantle. A mixed solution comprising 15.2 g of 4-acetylcatechol, 0.7 g of dibutyltin dilaurate and 40 g of ion exchanged water was prepared and added in drops through the dropping funnel while stirring over a period of 30 min. Thereafter, the mixture was heated to a temperature of 80° C. while continuing the stirring under nitrogen, and a reaction was allowed to proceed for 10 hr. The reaction mixture was cooled, and a dispersant in the form of a 10% aqueous hydrochloric acid solution was dissolved therein. The dispersion was filtered, and the solid matter was washed with water, dried under a reduced pressure of 20 mm Hg at 45° C. for 12 hr, and classified by means of a pneumatic classifier, thereby preparing an encapsulated powder having a mean particle diameter of 15.0 μm wherein the outer shell comprised a resin having a thermally dissociative urethane linkage.

2.0 parts by weight of carbon black ("Vulcan XC-72R"; a product of Cabot) and 0.4 part by weight of an impalpable powder of a hydrophobic silica ("Aerosil R-972"; a product of Nippon Aerosil Co., Ltd.) were added and mixed with 100 parts by weight of the encapsulated powder thus prepared, thereby preparing the powdered ink according to the present invention. This powdered ink will be referred to as the powdered ink 3. The glass transition point attributable to the resin in the core material was 30.2° C., and the softening point of the powdered ink 3 was 78.0° C.

EXAMPLE 4

The procedure up to the surface treatment step in Example 3 was repeated, except that 25.0 parts by weight of magnetite ("EPT-1001"; a product of Toda Kogyo Corp.) was used instead of 10.0 parts by weight of the carbon black "#44", thereby preparing a powdered ink. This powdered ink will be referred to as the powdered ink 4. The glass transition point attributable to the resin in the core material was 30.2° C., and the softening point of the powdered ink 4 was 90.0° C.

COMPARATIVE EXAMPLE 3

The procedure up to the surface treatment step in Example 3. was repeated, except that 10.4 g of neopentyl glycol was used instead of 15.2 g of 4-acetylcatechol, thereby preparing a powdered ink. This powdered ink will be referred to as the comparative powdered ink 3. The glass transition point attributable to the resin in the core material was 30.2° C., and the softening point of the comparative powdered ink 3 was 80.0° C.

EXAMPLE 5

A polymerizable composition (polymerizing constituent) was obtained in the same way as shown in Example 1, except for using 68.0 parts by weight of styrene and 32.0 parts by weight of butylacrylate in place of 2-ethylhexylacrylate. A capsulatea powder (capsulated pulverulent substance) was obtained in the same way as shown in Example 1, except for using 20.0 g of resorcinol, 3.4 g of diethyl malonate in place of m-aminophenol and 0.5 g of 1,4-diazabicyclo[2.2.2]octane in place of dibutyltin ailaurate. The core resin was found to have a glass transition point of 30.5° C. ana the powder ink 1, a softening point of 77.5° C.

COMPARATIVE EXAMPLE 4

Powder ink was obtained in the same way as shown in Example 5, except for replacing resorcinol and diethyl malonate for 20.0 g of neopentylglycol. The core resin of this comparative powder ink 4 was found to have a glass transition point of 30.5° C. and the comparative powder ink 4, a softening point of 85.0° C.

The powdered inks thus prepared were subjected to a printing test on the formation of an image and regeneration of an ink sheet according to a method shown in FIG. 1. A 6 μm-thick polyaramid film was used as the insulating support of the ink sheet.

In the printing of a solid, an amount of energy applied to the thermal head necessary for obtaining a printing density of 1.4 was compared by means of a Macbeth reflection densitometer. The results are given in Table 1.

TABLE 1

| | Energy necessary to impress thermal heads when a printing density of 1.4 is obtained (mJ/mm$^2$). |
|---|---|
| powder ink 1 | 7.5 |
| powder ink 2 | 8.0 |
| powder ink 3 | 6.5 |
| powder ink 4 | 7.0 |
| powder ink 5 | 6.2 |
| comparative powder ink 1 | Not specified since there are density irregularities through ink sheet reproduction disorder even at 20 mJ/mm$^2$. |
| comparative powder ink 2 | 18.0 |
| comparative powder ink 3 | Not specified since there are density irregularities through ink |

TABLE 1-continued

| | |
|---|---|
| | sheet reproduction disorder even at 20 mJ/mm$^2$. |
| comparative powder ink 4 | Not specified since there are density irregularities through ink sheet reproduction disorder even at 20 mJ/mm$^2$. |

It is evident in Table 1 that the pulverulent inks of the invention 1, 2, 3, 4 and 5 can be used and serve for printing at a smaller amount of energy than the comparative ink 2. The comparative inks 1 and 3 cannot be completely reclaimed on an ink sheet because of too a hard shell thereof in strength and therefore causes irregularity in image density when an energy of 20 mJ/mm2 applied to the thermal head. The powder inks 1 to 5 of the invention produced an printed image density of 1.4 even after 50 cycles or times of reproduction or reclaiming. On the other hand, the comparative ink 2 produced only a decreased density after 20 cycles.

What is claimed is:

1. A thermal transfer printing process which comprises:

(a) transferring a portion of an ink layer disposed on one side of an insulating support to a recording medium by a thermal transfer technique, thereby uncovering a portion of said insulating support on the ink layer side thereof and forming a corresponding ink image portion on said recording medium;

(b) depositing pulvrulent ink onto said ink layer side of said insulating support in the presence of a bias voltage to thereby electrostatically adhere said pulverulent ink to said uncovered portion of said insulating support; and (c) thermally fusing said electrostatically adhered pulverulent ink to thereby regenerate said ink layer;

wherein said pulverulent ink comprises a heat-fusible core which comprises a thermo-melting substance and a coloring matter and a shell covering the surface of said core which comprises a poly(thio-)urethane resin product produced by reacting;

(1) 0 to 30 mole % of a monovalent isocyanate compound and/or a monovalent isothiocyanate compound; and (2) 100 to 70 mole % of at least divalent isocyanate and/or at least divalent isothiocyanate compound, with (3) 0 to 30 mole % of a compound having one active hydrogen atom capable of reacting with the isocyanate and isothiocyanate groups os (1) and (2); and (4) 100 to 70 mole % of a compound having at least two active hydrogen atoms capable of reacting with the isocyanate and isothiocyanate groups of (1) and (2), at a molar ratio of ((1) and (2)): ((3) and (4)) in the range of 1:1 to 1:20, wherein at least 30 percent of all the linkages in said poly(-thio)urethane product that were formed from the iso(thio)cyanate moieties are thermally dissociating linkages which are formed by the reaction of a phenolic hydroxyl or thio group with an isocyanate or isothiocyanate group.

2. The process as claimed in claim 1, wherein the main component of the heat-fusible core is a thermoplastic resin and the glass transition temperature assignable to the resin is 10° to 50° C.

3. The process as claimed in claim 1, wherein said pulverulent ink has a softening point in the range of 60° to 130° C.

4. The process as claimed in claim 1, wherein the compound having a phenolic hydroxyl group is at least one compound selected from among those represented by the following formulas (I), (II) and (III):

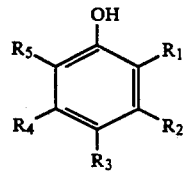

(I)

Wherein $R_1$, $R_2$, $R_3$, $R_4$, and $R_5$ each independently represent a hydrogen atom, an alkyl group having 1 to 9 carbon atoms, an alkenyl, alkoxy, alkanoyl, carboalkoxy or aryl group or a halogen atom;

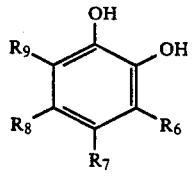

(II)

Wherein $R_6$, $R_7$, $R_8$, and $R_9$ each independently represent a hydrogen atom, an alkyl group having 1 to 6 carbon atoms, an alkenyl, alkoxy, alkanoyl, carboalkoxy or aryl group or a halogen atoms;

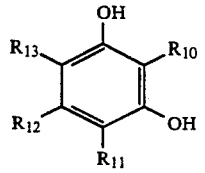

(III)

Wherein $R_{10}$, $R_{11}$, $R_{12}$, and $R_{13}$ each independently represent a hydrogen atom, an alkyl group having 1 to 6 carbon atoms, an alkenyl, alkoxy, alkanoyl, carboalkoxy or aryl group, or a halogen atom.

5. The process as claimed in claim 2, wherein said thermoplastic resin contained in said heat-fusible core is comprised mainly of a vinyl resin.

6. The process as claimed in claim 1, wherein said isocyanate group that is reacted with said phenolic hydroxyl group is directly bonded to an aromatic ring.

7. The method as claimed in claim 1, wherein said steps (a), (b) and (c) are sequentially carried out at least two times.

8. The method as claimed in claim 1, wherein said thermally fusing step comprises applying heat and pressure to said electrostatically adhered pulverulent ink.

* * * * *